United States Patent [19]

Risman

[11] 4,276,462

[45] Jun. 30, 1981

[54] MICROWAVE HEATING APPARATUS

[75] Inventor: Per O. Risman, Huskvarna, Sweden

[73] Assignee: Husqvarna Aktiebolag, Huskvarna, Sweden

[21] Appl. No.: 974,606

[22] Filed: Dec. 29, 1978

[30] Foreign Application Priority Data

Jan. 2, 1978 [SE] Sweden ..... 7800016

[51] Int. Cl.[3] ..... H05B 6/74

[52] U.S. Cl. ..... 219/10.55 F; 219/10.55 A; 219/10.55 R

[58] Field of Search ..... 219/10.55 A, 10.55 R, 219/10.55 F, 10.55 M, 10.55 B, 10.55 E

[56] References Cited

U.S. PATENT DOCUMENTS

| | | | |
|---|---|---|---|
| 2,497,670 | 2/1950 | Hanson et al. | 219/10.55 A |
| 3,422,240 | 1/1969 | Parker | 219/10.55 F |
| 3,440,383 | 4/1969 | Smith | 219/10.55 R |
| 3,461,261 | 8/1969 | Lewis et al. | 219/10.55 A |
| 3,670,134 | 6/1972 | Bucksbaum | 219/10.55 B |
| 3,909,598 | 9/1975 | Collins et al. | 219/10.55 R |
| 4,028,521 | 6/1977 | Uyeda et al. | 219/10.55 B |

FOREIGN PATENT DOCUMENTS 2757710 6/1978 Fed. Rep. of Germany ... 219/10.55 D

OTHER PUBLICATIONS

'Microwave Transmission Systems and Cavities', pp. 12-6-12-9, Resonant Cavities, by FAA Academy, 3/1974.

*Primary Examiner*—B. A. Reynolds
*Assistant Examiner*—Philip H. Leung
*Attorney, Agent, or Firm*—Alfred E. Miller

[57] ABSTRACT

A microwave heating apparatus for heating disc-shaped loads of variable water content wherein the energy is introduced by way of a sonde antenna connected to a coaxial cable, the disc-shaped load is positioned at the axial center of the chamber, and the apparatus is dimensioned to produce TM011 wave patterns, TM010 wave patterns, or a combination thereof, depending upon the dielectric constant of the load. The positioning means for the load may be connected to an external balance for continuously weighing the load.

11 Claims, 6 Drawing Figures

MICROWAVE HEATING APPARATUS

BACKGROUND OF THE INVENTION

This invention relates to a microwave heating apparatus, comprising an applicator and microwave source.

One type of microwave applicator, well suited for heating of loads with relatively small surface/volume ratios, is described in the Swedish Pat. No. 77 05965-7. Such a low ratio exists e.g. for cubes, cylinders and spheres. In this reference, a number of undesirable properties of ordinary microwave ovens are described. These undesirable properties can be eliminated by employing special applicators for small loads. The type of applicator described in the above patent is thus suited for cubical, cylindrical or spherical loads, but is not suitable for disc-shaped loads. For the treatment of such loads, another field pattern is required.

SUMMARY OF THE INVENTION

The purpose of the present invention is to provide means for evenly heating a stationary, disc-shaped load. An example of a use of such an applicator is the drying of test specimens containing water for water determination. This means that the thickness in relation to the dielectric properties (with varying water content) must be in a given range so that the inner parts of the load are not shielded from the microwaves by the load itself. Since the penetration depth for common substances in this context may be very small (in the range 1.5–5 mm), the thickness of the load must not exceed this range. A design involving a stationary load in relation to the applicator is important, since simultaneous weighing and heating/drying will simplify the mechanical design. The requirements of even microwave field distribution are not fulfilled by any previously known devices for heating of thin loads by microwaves.

In accordance with the type of applicator provided by the present invention, the load is initially heated by an electric field that is essentially parallel to the surface of the load, resulting in a low power reflection which ensures a high efficiency. Furthermore, the applicator is resonant, meaning that the field can be stronger and be better matched than e.g. under ordinary radiant heat conditions (resulting in a higher efficiency), and also allowing the resonator to be matched so that the microwave efficiency varies in a predetermined manner as a function of the dielectric properties of the load. It is thus possible to design the applicator for high efficiency when the water content of the load is high, and to then decrease during the drying process. A more even drying, with a reduced risk of overheating of the load when it starts to dry out, is thereby achieved. The properties which, according to the present invention, inherently give the applicator these advantages are more completely specified and defined in the following disclosure.

BRIEF FIGURE DESCRIPTION

One applicator design according to the present invention is described in detail below with reference to the attached drawings, wherein.

DETAILED DISCLOSURE OF THE INVENTION

Figure 1:
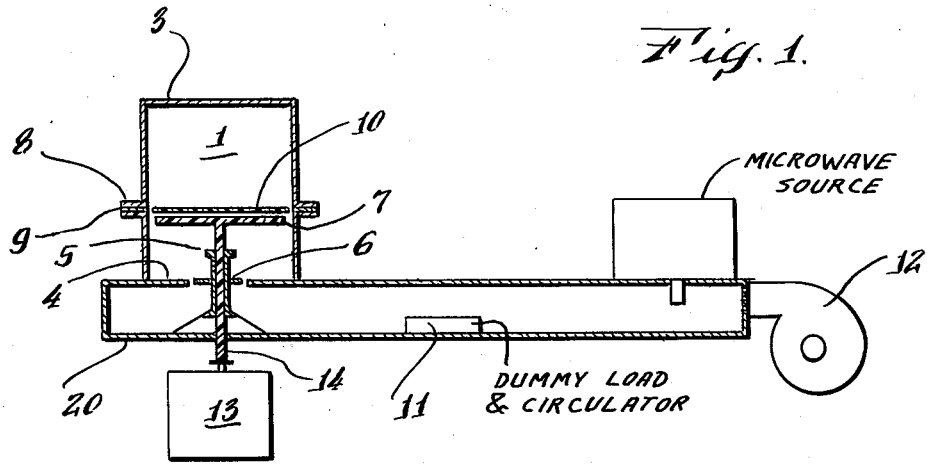
FIG. 1 is a simplified cross-sectional view of a microwave heating apparatus according to the present invention.

Referring to the drawings, and more in particular to FIG. 1, the applicator has a shape of a cylindrical chamber 1. The chamber can be partitioned on a circular plane into two parts, a bottom part 2 and a lid 3, in order to enable loading of the chamber. It is fed by a sonde antenna 5 protruding through the lower circular surface 4, from coaxial line 6 which in turn extends into underlying waveguide 20. In the partitioning plane between the upper and lower parts 2 and 3, there is a microwave transparent support grid 7. Sealing flanges 8 and 9 on the upper and lower parts form a capacitive seal for the chamber. A disc-shaped load 10 is placed on the grid within the chamber.

The inner diameter of the outer conductor of a coaxial line can be chosen arbitrarily small without the microwave transmission capability vanishing. In practice, however, the dimensions of outer/inner conductors are chosen for the power transmission capability (which increases for increasing cross section dimensions) to be sufficient both from field strength and resistive loss considerations, so that the requirements of a characteristic impedance for system matching are fulfilled and so that either requirements on space, flexible cable or simultaneous use for mechanical fastening of other system details (such as the applicator) are fulfilled.

In one example of the present invention, the coaxial line may be excited by a so-called dumbbell transition directly from the rectangular TE10 waveguide 20.

The dimensions of the applicator are chosen for two conditions to be fulfilled: (a) conditions for cylindrical TM011 exist at resonance and (b) a TM010 field pattern is created at non-resonance. This requires the applicator dimensions to be comparatively closely determined with respect to the microwave wavelength, and the load position also to be well specified. Also the applicator height ($z_o$) must be selected within tight limits to avoid disturbances from other unwanted resonance modes, e.g. by $$0.8\ r_o < z_o < 4 \cdot r_o$$

where $r_o$ is the cylinder radius

Cylindrical TM011-resonance in an empty cavity can be excited when the following condition is fulfilled:

$$\beta^2 = (\omega/c)^2 - (x_{ol}/r_o)^2 = (\pi/z_o)^2,$$

where $\omega$ is the angular frequency of the microwaves (frequency $f = \omega/2\pi$), c is the velocity of light $x_{ol}$ is the first zero of the Bessel function $J_o$ ($x_{ol} = 2.405$)

$\beta$ is a wave propagation constant $\beta$ is influenced by a load with the dielectric constant $\epsilon_r$. Since the imaginary part $\epsilon''_r$ is generally smaller than the real part $\epsilon'_r$ ($\epsilon_r=\epsilon'_r-j\epsilon''_r$), this is essential to the field pattern and one may consider only the electrical field (E) and not the magnetical field (H) of the applicator to determine the heating pattern. E, in cylindrical coordinates r, $\theta$, z, is;

$$E_r=A\ (\beta/k)\ (J_l(kr))\cdot\sin\beta z$$

$$E_\theta=0$$

$$E_z=A\cdot J_o\ (kr)\cdot\cos\beta z$$

where A is an arbitrary constant and $k=x_{ol}/r_o$.

Figure 2:
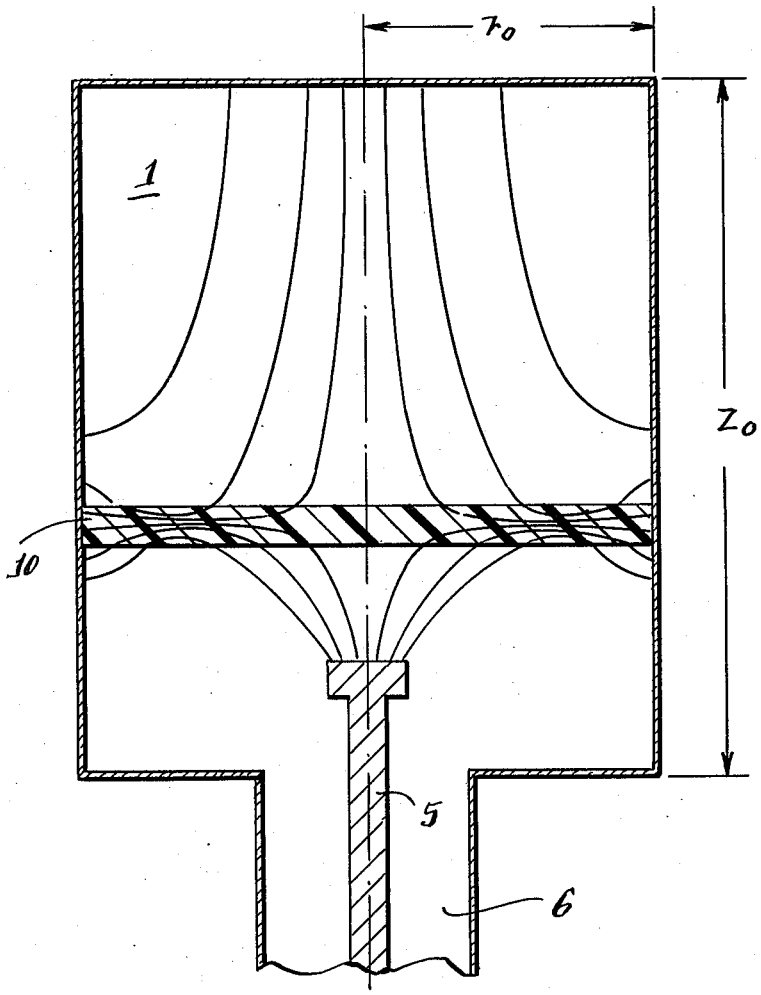
FIG. 2 is an enlarged simplified view of the applicator of FIG. 1 with load and the field pattern of the cylindrical TM011 mode, during an initial drying stage.
Figure 3:
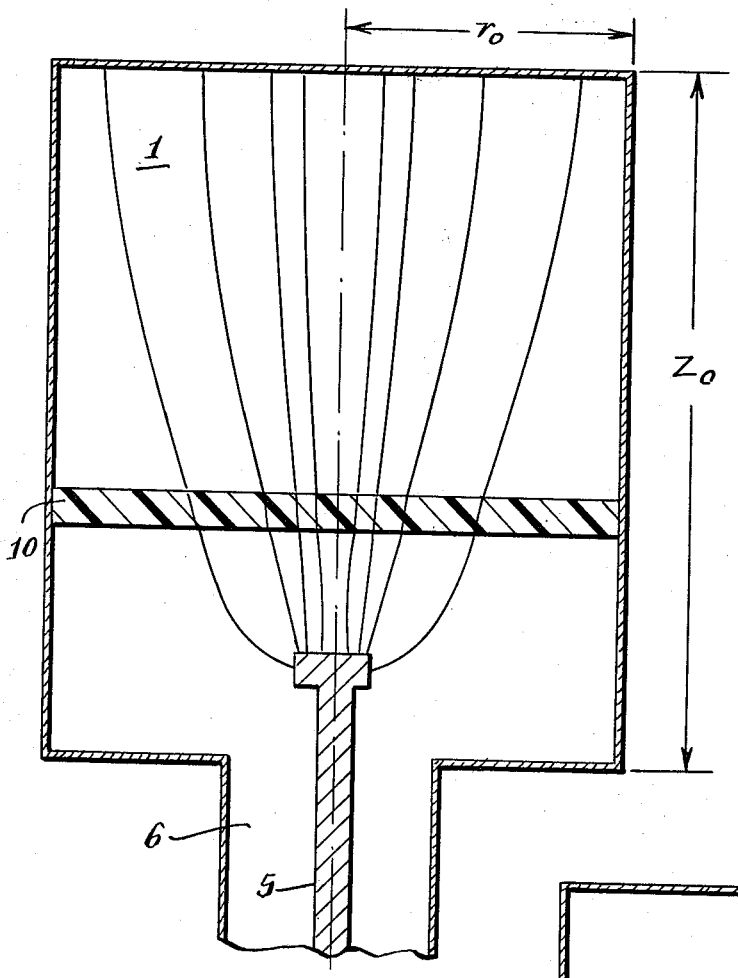
FIG. 3 is an enlarged simplified view of the applicator of FIG. 1 with load and the filed pattern of the cylindrical TM010 mode, during an intermediate drying stage.
Figure 4:
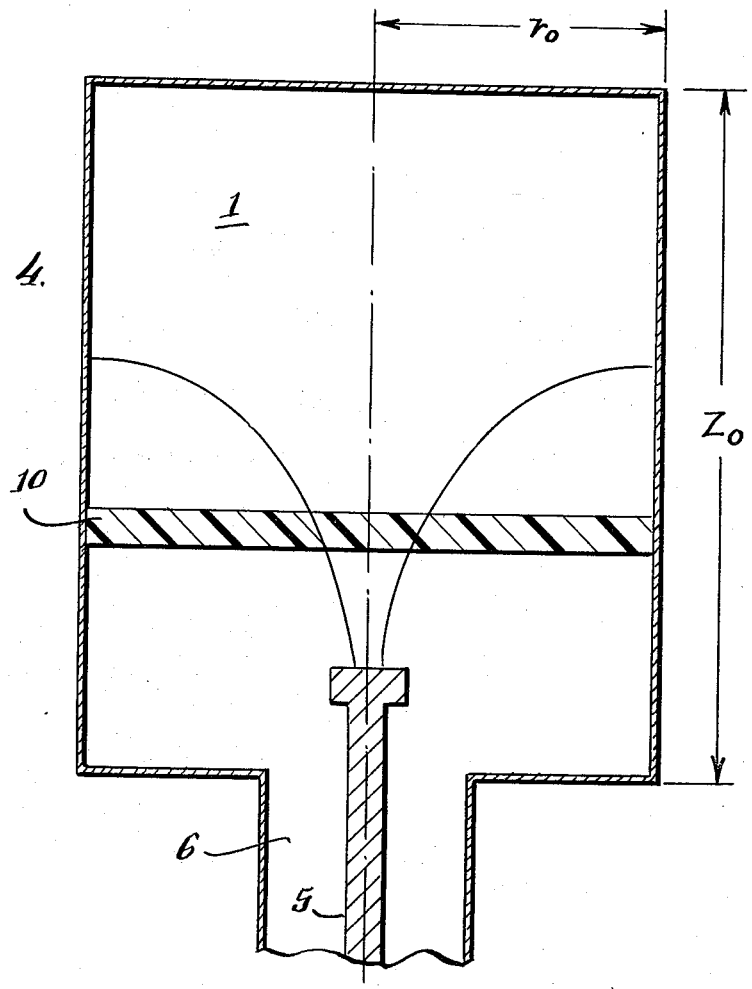
FIG. 4 is an enlarged view of the applicator with a dried load.

When the load 10 is placed according to FIGS. 2–4, the heating procedure will be determined by $E_r$ and $E_z$ above. If the water content of the load (and the associated dielectric constant) are initially assumed to be constant, it is possible to choose the load position in the z direction so that the total powers of the $E_r$ and $E_z$ fields will result in a relatively constant power density, proportional to $E^2=A_1\cdot E_r^2+A_2\cdot E_z^2$. In the beginning, most of the absorption will be due to the TM011 field but the total energy absorption in radial direction will approximately be a summed function as in the simplified case; the load position in the z direction must however be empirically determined.

In one example of heating pattern, ($A_1=1$, $A_2=2.67$) if $\beta$ is $=0$, the condition for TM010 resonance is fulfilled. This resonance has an electric field only in the z direction:

$$E_z=A\cdot J_0(kr)$$

which is independent of $z_o$. According to the expression for $\beta$ above, the TM010 resonance corresponds to the limiting case of TM011 resonance for an indefinitely long resonator. When the applicator diameter $2\cdot r_o$ is chosen to be about $0.77\cdot\lambda$ ($\lambda$ is the wavelength corresponding to f; $\lambda=c/f$) TM011 resonance is excited. For the quotient diameter/height ($=2r_o/z_o$) e.g.$=0.85$, TM011 resonance is obtained for the applicator diameter $0.88\cdot\lambda$. For this latter applicator diameter, the TM011 field will dominate the energy absorption pattern during the heating process, whereas for the former diameter, the TM010 field will dominate instead. For a given diameter/height ratio, the applicator diameter should thus be between $0.77\lambda$ and the value determined by empty TM011 resonance.

Figure 5:
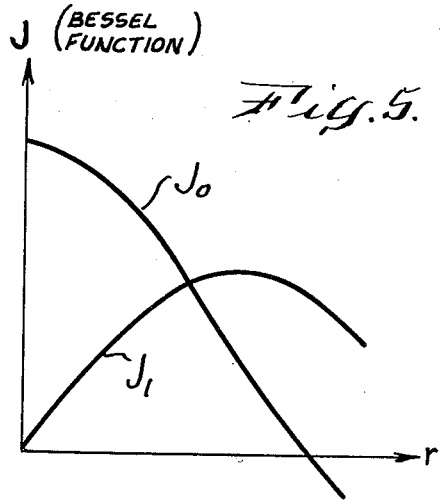
FIG. 5 shows curves of the Bessel functions $J_o(r)$ and $J_1(r)$.

It can be seen in FIG. 2, that the TM011 field in the load is zero in the center of the load at resonance conditions. This field pattern is related to the function $J_l(r)$, which is graphically depicted in FIG. 5. In FIG. 3 it is shown, that the TM010 field has a maximum in the center. This field pattern is related to the function $J_o(r)$, which is also depicted in FIG. 5. In the way these fields are developed (according to FIGS. 2 and 3) it is essential to position the load in the applicator so that the most favorable balance between the two field types is obtained. When such a balance is reached, the summed power densities in the loads will provide an even power density over the whole circular load surface. This balance is however dependent upon the water content of the load. During the first part of the heating process, TM011 resonance is excited as a result of the whole load volume having a relatively high $\epsilon'_r$ value. During this period, the load is heated and dried in a ring shaped pattern along the periphery, resulting in a decrease of the dielectric constant. This results in a translation and transformation of the field to TM010, so that the central parts of the load are heated and dried. When the whole load due to a low dielectric constant (dry load) does not absorb power any longer, most of the energy is reflected back to the waveguide. Expressed in another way, the applicator heats the load only where it contains water. This property results in even drying and a low risk of overheating of the mass. The reflected energy is absorbed by a dummy load 11, which can be connected to a circulator inserted in the waveguide or the dummy load being inserted directly into the waveguide as is shown in FIG. 1. In this figure, a device for evacuation of the applicator is also shown. A blower 12 blows air through the waveguide 20, so that the air flows into the applicator at the sonde antenna via suitable openings in the bottom of the cylinder as shown in FIG. 1. The air passes in close contact with the load and is exhausted via suitable apertures (not shown) in the top piece 3. The air stream of this specific embodiment is also used for cooling the dummy load 11, which will give a suitably heated air stream for drying. The mesh ring 7 shown in FIG. 1 can be supported on a balance 13 by means of a movable plunger 14 extending longitudinally and slidably within the sonde antenna 5. The plunger 14 is connected to a balance mechanism located at its lower end. By this arrangement it is possible to continuously weigh the load during drying and to stop treatment when the load weight no longer decreases.

While the invention has been described and disclosed with reference to a single embodiment, it will be apparent that variations and modifications may be made therein, and it is therefore intended in the following claims to cover each such variation and modification as falls within the true spirit and scope of the invention.

What is claimed is:

1. In a microwave heating apparatus including a cylindrical chamber having a circular wall at one end, a microwave source and means directing microwaves from said source to said chamber, the improvement wherein said directing means comprises a coaxial transmission line extending through the center of said circular wall of said chamber, and a sonde antenna terminating said line in said chamber, for supplying electric energy to said chamber, microwave transparent load positioning means shaped to position a disc-shaped load in a plane normal to the axis of said chamber at a distance approximately half the height of the chamber from said sonde antenna, said chamber having a height $z_o$ between $0.8r_o$ and $4r_o$, wherein $r_o$ is the chamber radius, and wherein the diameter of said chamber is between 0.77 times the wavelength of said microwaves and the diameter of the chamber for empty resonance for $TM_{011}$ mode microwaves, whereby said chamber will be resonant for water containing disc-shaped loads on said supporting means in the $TM_{011}$ mode and will support microwaves in the $TM_{010}$ mode in the absence of water in said load.

2. The microwave heating apparatus of claim 1 wherein the axis of said chamber is vertical and said chamber has a cylindrical bottom part joinable to a cylindrical lid by way of sealing flanges along a transverse plane between said bottom and lid.

3. The microwave heating apparatus of claim 1 further comprising a weighing mechanism connected to said load positioning means for continuously weighing a load thereon during use of said apparatus.

4. The microwave heating apparatus of claim 3 wherein said weighing mechanism comprises a weighing balance mounted below said chamber, and comprising means movably extending through said antenna for supporting said load positioning means of said weighing mechanism.

5. The apparatus according to claim 1 wherein a waveguide is mounted below said chamber for supplying microwave energy to said antenna, and further comprising a source of cooling air coupled to said waveguide, said chamber having apertures in its lower end for receiving air from said waveguide.

6. The apparatus of claim 1 wherein said chamber is in resonance in the $TM_{011}$ mode in the presence of a disc-shaped load having a thickness between 1.5 and 5.0 millimeters on said supporting means when said load contains water.

7. In a microwave heating apparatus including a cylindrical chamber having a circular wall, a microwave source and means directing microwaves from said source to said chamber, the improvement wherein said directing means comprises a coaxial transmission line extending through the center of said circular wall of said chamber, and a sonde antenna terminating said line in said chamber, for supplying electric energy to said chamber, and further comprising microwave transparent load supporting means shaped to position a disc-shaped load in a plane normal to the axis of said chamber at a distance approximately half the height of the chamber from said sonde antenna, wherein $0.8r_o$ is less than $z_o$ which is less than $4r_o$, $z_o$ being the axial height of the chamber and $r_o$ being the chamber radius, said chamber being dimensioned to be resonant in the $TM_{011}$ mode in the presence of a disc-shaped water containing load on said support means in said plane, the diameter of said chamber being greater than 0.77 times the wavelength of said microwaves, and less than the diameter for resonance in the $TM_{011}$ mode in unloaded condition, for a given diameter to length ratio.

8. The microwave heating apparatus of claim 7 wherein said chamber has a vertical axis, said means for positioning a load comprising microwave transparent means for supporting a disc-shaped load at a position within said chamber substantially at half the height of said chamber, said sonde antenna being below said positioning means.

9. The microwave heating apparatus of claim 8 for heating a disc-shaped load containing water, wherein said chamber is dimensioned to be at resonance for the production of a TM011 wave at the maximum water containing condition of said load, and for producing a TM010 wave at lower levels of water in said load.

10. The apparatus of claim 7 wherein said coaxial line is a dumbbell transition extending from a $TE_{10}$ waveguide.

11. The apparatus of claim 7 wherein said chamber is dimensioned to be resonant in the $TM_{011}$ mode in the presence of a disc-shaped water containing load of 1.5 to 5.0 millimeters in thickness, whereby said chamber will support $TM_{010}$ mode energy in the absence of a water containing load.

* * * * *